US011351783B2

(12) United States Patent
Hayashi

(10) Patent No.: US 11,351,783 B2
(45) Date of Patent: Jun. 7, 2022

(54) LIQUID EJECTION HEAD

(71) Applicant: Brother Kogyo Kabushiki Kaisha, Nagoya (JP)

(72) Inventor: Hideki Hayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/887,240

(22) Filed: May 29, 2020

(65) Prior Publication Data

US 2020/0384772 A1 Dec. 10, 2020

(30) Foreign Application Priority Data

Jun. 6, 2019 (JP) ..... JP2019-106012

(51) Int. Cl.
*B41J 2/14* (2006.01)

(52) U.S. Cl.
CPC .. *B41J 2/14233* (2013.01); *B41J 2002/14306* (2013.01)

(58) Field of Classification Search
None
See application file for complete search history.

(56) References Cited

U.S. PATENT DOCUMENTS 10,093,102 B2 10/2018 Kimura
2002/0180840 A1* 12/2002 Matsumoto ..... B41J 2/1628 347/65
2005/0104922 A1* 5/2005 Silverbrook ..... B41J 2/16 347/20
2016/0311225 A1* 10/2016 Hara ..... B41J 2/16508
2018/0086084 A1 3/2018 Kimura

FOREIGN PATENT DOCUMENTS

JP 2018-051768 A 4/2018

* cited by examiner

*Primary Examiner* — Erica S Lin
(74) *Attorney, Agent, or Firm* — Banner & Witcoff, Ltd.

(57) ABSTRACT

A liquid ejection head includes a flow channel structure, a supply channel structure, a piezoelectric element, a sealing substrate, and a heater. The flow channel structure defines an ejection channel including an individual channel and a manifold. The individual channel has a nozzle and a pressure chamber in which pressure is applied to liquid for causing the liquid to be ejected from the nozzle. The supply channel structure defines a supply channel configured to allow the liquid to flow therethrough to the ejection channel. The piezoelectric element is positioned on an upper surface of the flow channel structure and facing the pressure chamber via a vibration plate. The sealing substrate is made of a material having a higher thermal conductivity than the supply channel structure. The sealing substrate surrounds the piezoelectric element on the flow channel structure to seal the piezoelectric element. The heater is disposed at the sealing substrate.

9 Claims, 9 Drawing Sheets

LIQUID EJECTION HEAD

CROSS-REFERENCE TO RELATED APPLICATION

This application claims priority from Japanese Patent Application No. 2019-106012 filed on Jun. 6, 2019, the content of which is incorporated herein by reference in its entirety.

TECHNICAL FIELD

Aspects of the disclosure relate to a liquid ejection head that ejects liquid such as ink.

BACKGROUND

Known liquid ejection apparatuses include, for example, inkjet printers. Some known liquid ejection apparatus is configured to eject liquid toward a medium such as a recording sheet from a liquid ejection head (hereinafter, simply referred to as the "head") to form an image on the medium. Such a head may include a heater that is configured to heat a supply channel structure that allows liquid to flow therethrough.

For example, some known head includes a flow channel structure, a supply channel structure, and a heater. The flow channel structure includes an ejection channel that allows liquid to flow therethrough to nozzles. The supply channel structure includes a supply channel that allows liquid to flow into the ejection channel. The heater is configured to heat the supply channel structure. The supply channel structure is made of synthetic resin. The flow channel structure is made of inorganic material such as silicon having a lower linear expansion coefficient than synthetic resin. In the known head, the flow channel structure and the supply channel structure are bonded to each other by thermosetting adhesive. In such a known head, the supply channel structure may be expanded by heat generated by the heater, thereby reducing residual stress that may arise in the known head due to a difference in thermal contraction between the flow channel structure and the supply channel structure after thermosetting adhesive is set.

In order to eject relatively high viscosity liquid from nozzles effectively, liquid may need to be heated to a temperature slightly higher than room temperature (e.g., approximately 40 degrees Celsius) to cause liquid to have a desirable viscosity. The known head is configured to heat the supply channel structure using the heater to apply heat to liquid.

SUMMARY

As described above, the known head may include the heater for heating the supply channel structure made of synthetic resin. Nevertheless, synthetic resin may have a relatively low thermal conductivity. Thus, it may be difficult to effectively heat liquid flowing through the ejection channel, more specifically, a manifold.

Accordingly, aspects of the disclosure provide a liquid ejection head in which heat generated by a heater may be transferred to liquid effectively.

In one or more aspects of the disclosure, a liquid ejection head may include a flow channel structure, a supply channel structure, a piezoelectric element, a sealing substrate, and a heater. The flow channel structure may define an ejection channel including an individual channel and a manifold. The individual channel may have a nozzle and a pressure chamber in which pressure may be applied to liquid for causing liquid to be ejected from the nozzle. The manifold may be configured to allow liquid to flow therefrom to the individual channel. The supply channel structure may define a supply channel configured to allow liquid to flow therethrough to the ejection channel. The piezoelectric element may be positioned on an upper surface of the flow channel structure and facing the pressure chamber via a vibration plate. The sealing substrate may be made of material having a higher thermal conductivity than the supply channel structure. The sealing substrate may surround the piezoelectric element on the flow channel structure to seal the piezoelectric element. The heater may be disposed at the sealing substrate.

According to the one or more aspects of the disclosure, the heater may be disposed at the sealing substrate, thereby enabling heat generated by the heater to be transferred to the flow channel structure via the sealing substrate. Thus, as compared with a case where a heater is disposed at a supply channel structure having a lower thermal conductivity than a sealing substrate, the configuration according to the one or more aspects of the disclosure may enable effective transfer of heat generated by the heater to the flow channel structure.

According to the one or more aspects of the disclosure, the liquid ejection head includes the above-described configuration, thereby enabling effective transfer of heat generated by the heater to liquid.

DETAILED DESCRIPTION

A liquid ejection apparatus 1 and a liquid ejection head 13 (hereinafter, simply referred to as the "head 13") according to an illustrative embodiment will be described with reference to the accompanying drawings. In the description below, the liquid ejection apparatus 1 may be, for example, an ink ejection apparatus that may eject ink onto a recording sheet P.

Configuration of Liquid Ejection Apparatus

Figure 1:
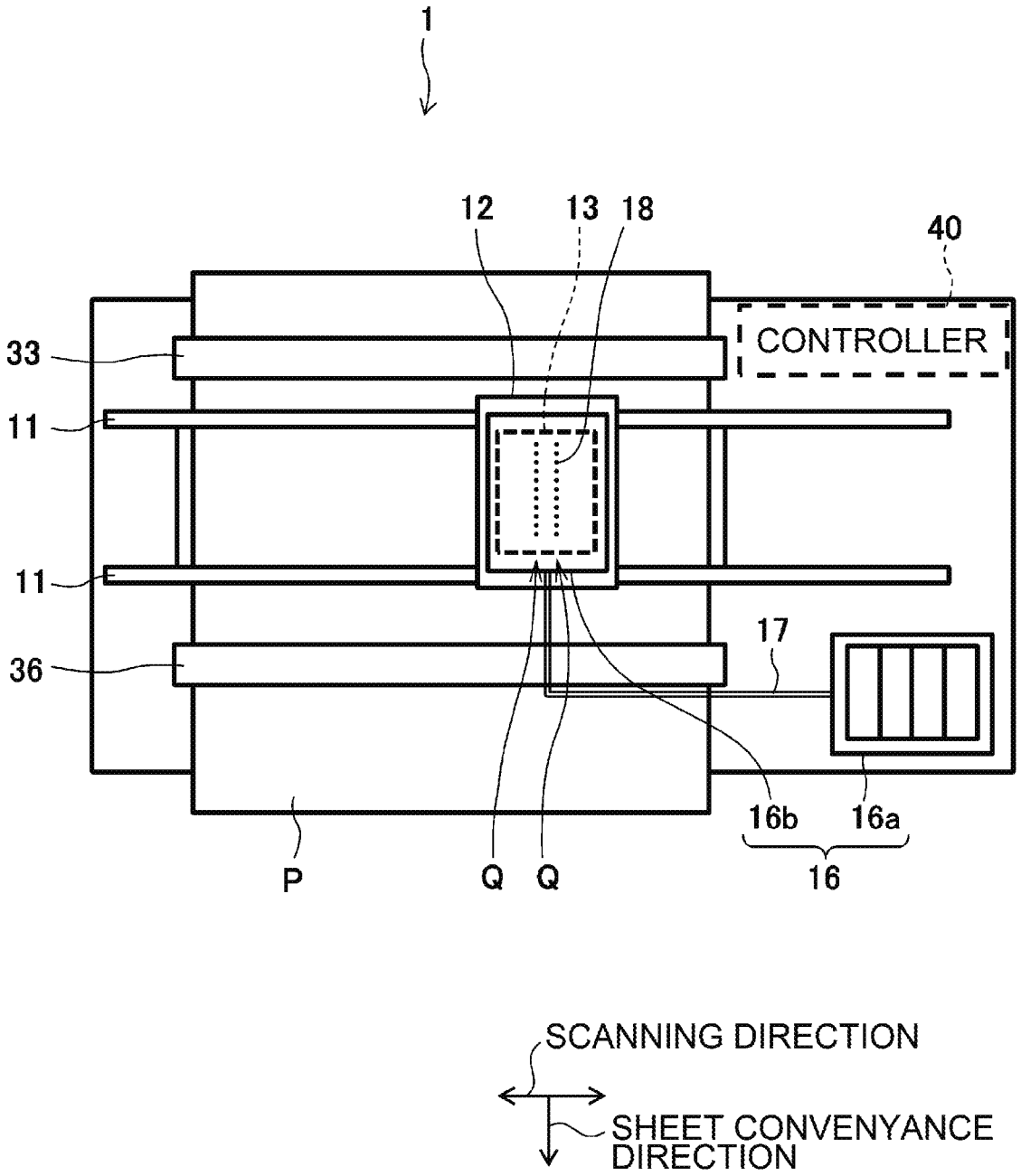
FIG. 1 is a schematic top plan view illustrating a general configuration of a liquid ejection apparatus according to an illustrative embodiment of the disclosure.

As illustrated in FIG. 1, the liquid ejection apparatus 1 includes a head scanner including a carriage 12, a guide member 11, and an endless belt. The head scanner is configured to reciprocate the head 13. The guide member 11 includes two support rods. The support rods are spaced apart from each other in a sheet conveyance direction and extend along a scanning direction orthogonal to the sheet conveyance direction. The carriage 12 is mounted to the guide member 11 so as to be slidable. The head scanner is configured to move the head 13 back and forth along the scanning direction.

Figure 2:
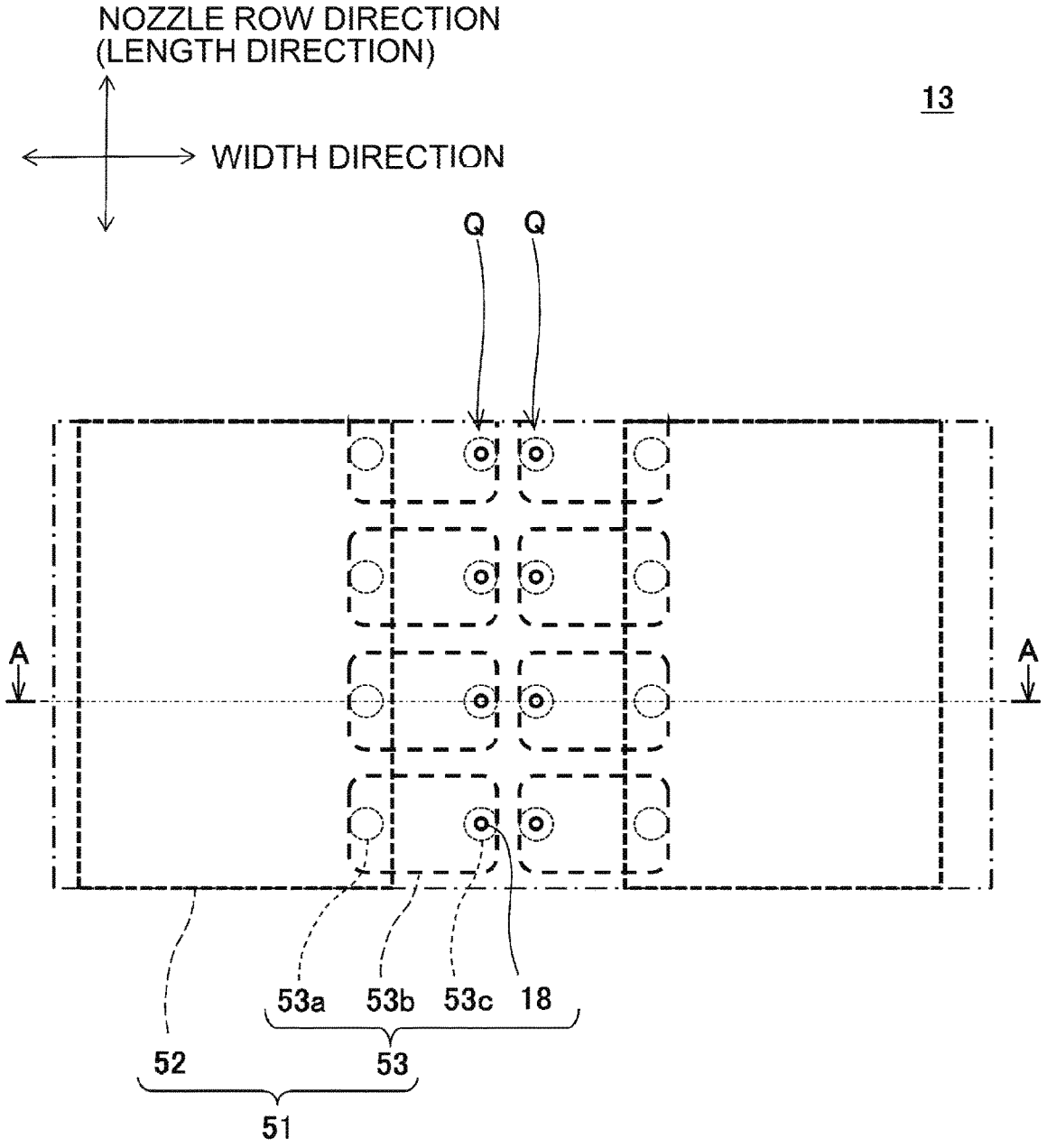
FIG. 2 is a partial sectional view illustrating a liquid ejection head ("head") of the liquid ejection apparatus of FIG. 1 according to the illustrative embodiment of the disclosure, when viewed from a nozzle surface of the head.
Figure 3:
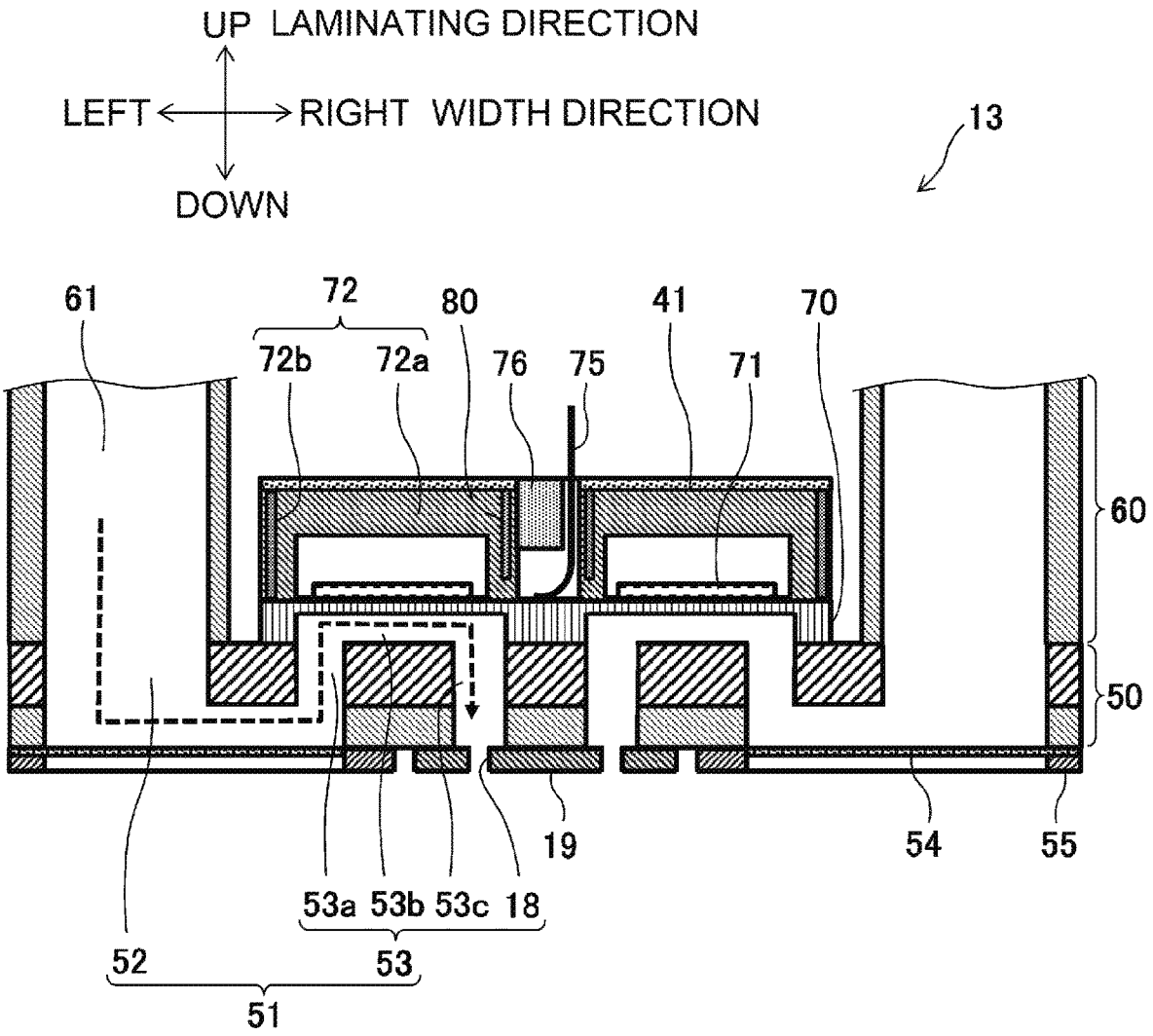
FIG. 3 is a sectional view of the head taken along line A-A of FIG. 2 according to the illustrative embodiment of the disclosure.

The head 13 is configured such that its lower surface faces a recording sheet P. The lower surface of the head 13 has nozzles 18 of respective corresponding individual channels 53 as illustrated in FIG. 2. The lower surface of the head 13 may be a nozzle surface 19 as shown in FIG. 3. A plurality of individual channels 53 are provided for a single manifold 52 (refer to FIG. 2). Nozzles 18 corresponding to the respective individual channels 53 constitute a single nozzle row Q. In FIG. 1, the head 13 has two nozzle rows Q each extending along the sheet conveyance direction.

The liquid ejection apparatus 1 further includes a plurality of tanks 16. The tanks 16 are connected to the head 13. Each tank 16 includes a sub tank 16*b* and a storage tank 16*a*. The sub tank 16*b* is disposed on the head 13. The storage tank 16*a* is connected to the sub tank 16*b* via a tube 17. The sub tanks 16*b* and the storage tanks 16*a* each hold liquid therein. The number of tanks 16 provided corresponds to the number of colors of liquid to be ejected from the nozzles 18 corresponding to the respective individual channels 53. In the illustrative embodiment, for example, four tanks 16 are provided for four colors (e.g., black, yellow, cyan, and magenta) of liquid. Thus, the head 13 may eject different kinds or types (e.g., colors) of liquid.

The liquid ejection apparatus 1 is configured to record or form an image on a surface of a recording sheet P by performing scanning of the carriage 12 and conveyance of the recording sheet P alternately. A movable range of the carriage 12 includes a sheet conveyance area and opposite side areas (e.g., one side area and the other side area) of the sheet conveyance area in the scanning direction. That is, the carriage 12 is configured to move beyond the sheet conveyance area to each of the side areas. One side area of the sheet conveyance area includes a standby position for the head 13. In response to turning the power of the liquid ejection apparatus 1 off, the head 13 is moved to the standby position and the nozzle surface 19 is covered by a cap. A maintenance port for the head 13 is provided at the other side area of the sheet conveyance area. The head 13 may undergo maintenance (e.g., flushing or purging) at the maintenance port.

In the illustrative embodiment, the head 13 may be a serial head. Nevertheless, in other embodiments, for example, the head 13 may be a line head instead of a serial head.

The controller 40 includes, for example, a CPU, a ROM, a RAM, and an EEPROM. A motor driver IC for a conveyance motor is connected to the controller 40. The motor driver IC is configured to drive the conveyance motor that rotates a conveyance roller 33 and a discharge roller 36 in a sheet conveyor for conveying a recording sheet P. Another motor driver IC for a carriage motor is also connected to the controller 40. The motor driver IC is configured to drive the carriage motor to reciprocate the carriage 12 in the scanning direction. A head driver IC for piezoelectric elements 71 of the head 13 is also connected to the controller 40. Heaters 41 and temperature sensors 42 (refer to FIGS. 3 and 4) are also connected to the controller 40.

In response to the controller 40 receiving a print job inputted by a user or sent from an external communication device, for example, the CPU stores image data relating to the print job in the RAM and outputs an instruction to execute the print job based on one or more programs stored in the ROM. The controller 40 controls the driver ICs to execute a printing process based on the image data stored in the RAM. The controller 40 is configured to receive detection signals from the temperature sensors 42 and control on and off of the heaters 41 based on the detection signals.

Configuration of Head

Referring to FIGS. 2 and 3, a configuration of the head 13 will be described. As indicated by directional arrows in FIG. 2, a nozzle row direction in which nozzles belonging to a nozzle row Q are aligned may be defined. The nozzle row direction may correspond to a length direction of the head 13. As indicated by the directional arrows in FIG. 2, a width direction of the head 13 may be defined. The width direction may correspond to the scanning direction of FIG. 1. As indicated by directional arrows in FIG. 3, a height direction of the head 13 may be defined. The height direction may correspond to a laminating direction in which plates constituting the head 13 are laminated. A side of the head 13, in which the nozzle surface 19 may be provided, may be defined as a lower side of the head 13. As indicated by the directional arrows in FIG. 3, the width direction may be defined. The width direction may correspond to a right-left direction. The width direction is perpendicular to the laminating direction and the nozzle row direction.

As illustrated in FIG. 2, the head 13 includes manifolds 52 and a plurality of individual channels 53. When viewed from the nozzle surface 19, the manifolds 52 are defined in right and left portions, respectively, of the head 13. Each individual channel 53 extends along the width direction from a corresponding one of the manifolds 52 toward a middle portion of the head 13. The head 13 has a plurality of nozzle rows, for example, two nozzle rows Q between the right and left manifolds 52.

As illustrated in FIG. 3, the head 13 includes a flow channel structure 50 and supply channel structures 60. The flow channel structure 50 may be made of, for example, silicon that can be microfabricated. The supply channel structures 60 may be made of, for example, synthetic resin. The supply channel structures 60 are disposed on the flow channel structure 50.

The flow channel structure 50 includes a plurality of plates laminated one above another in the up-down direction to define ejection channels 51. Each ejection channel 51 includes a plurality of individual channels 53 and a manifold 52 that allows liquid to flow therethrough to the individual channels 53. Each individual channel 53 includes a nozzle 18 and a pressure chamber 53*b*. In the pressure chamber 53*b*, a pressure for causing liquid ejection from the nozzle 18 may be applied to liquid. The supply channel structures 60 have respective supply channels 61. The supply channel structures 60 are disposed on the flow channel structure 50 such that the supply channels 61 are positioned above the respective ejection channels 51. The supply channels 61 are configured to allow liquid to pass therethrough to flow into the respective corresponding ejection channels 51. The head 13 further includes piezoelectric elements 71 on an upper surface of the flow channel structure 50. The piezoelectric elements 71 are positioned facing respective corresponding pressure chambers 53*b* via a vibration plate 70. The piezoelectric elements 71 are surrounded and sealed by sealing substrates 72 on the flow channel structure 50. The head 13 further includes heaters 41. The heaters 41 are disposed at the respective sealing substrates 72.

The head 13 has the nozzle surface 19 (e.g., a nozzle plate) at the lowest position. The nozzle surface 19 has a plurality of nozzles 18 penetrating therethrough in a thickness direction of the nozzle plate. The nozzle surface 19 has a plurality of nozzle rows Q each consisting of the specified number of nozzles 18. The nozzle rows Q are spaced apart from each other at specified intervals in the width direction and positioned parallel to each other. In each nozzle row Q, nozzles 18 are spaced apart from each other at specified intervals in the length direction (refer to FIG. 2).

The head 13 may have a symmetric structure with respect to the center line thereof in the width direction, and therefore, one of the halves of the head 13 will be described. Note that plural same components have the same or similar configuration and function in the same or similar manner to each other. Therefore, one of the plural same components will be described. An ejection channel 51 has at least one elongated damper 54. The damper 54 is positioned below at least the manifold 52. The damper 54 is configured to, in response to liquid vibrating due to vibration waves propagating in the manifold 52, elastically deform in the thickness direction to attenuate the liquid vibrations. That is, the damper 54 may reduce or prevent change in pressure to be imparted to liquid in the manifold 52, thereby reducing or preventing liquid ejection of a particular nozzle 18 from affecting a liquid ejection property of an adjacent nozzle 18 (i.e., crosstalk). In the illustrative embodiment, the damper 54 may be, for example, a resin film. The damper 54 is held by a frame 55 and defines a lower surface of the ejection channel 51, more specifically, a lower surface of the manifold 52.

The manifold 52 may have a rectangular shape elongated in the length direction. The manifold 52 is configured to allow liquid to pass therethrough. The individual channels 53 are provided in a one-to-one correspondence with the nozzles 18. The individual channels 53 are connected to the manifold 52. All of the individual channels 53 may have the same configuration, and therefore, one of the individual channels 53 will be described in detail. An individual channel 53 includes a restrictor 53*a* and a descender 53*c*. The restrictor 53*a* provides fluid communication between a pressure chamber 53*b* and the manifold 52. The descender 53*c* provides fluid communication between the pressure chamber 53*b* and a nozzle 18 corresponding to each other.

The restrictor 53*a* has an upstream end connected to the manifold 52 and a downstream end connected to the pressure chamber 53*b* in a liquid flow direction (indicated by a dashed arrow in FIG. 3). The restrictor 53*a* may be a hole extending in the laminating direction.

The descender 53*c* has an upstream end connected to the pressure chamber 53*b* and a downstream end connected to the nozzle 18 in the liquid flow direction. When viewed in the laminating direction, the pressure chamber 53 is disposed overlapping the descender 53*c*. The descender 53*c* may be a hole extending downward in the laminating direction.

The pressure chamber 53*b* is positioned between the restrictor 53*a* and the descender 53*c* in the liquid flow direction. In the pressure chamber 53*b*, pressure may be applied to liquid flowing from the restrictor 53*a* to cause liquid ejection from the nozzle 18 via the descender 53*c*. The pressure chamber 53*b* has an upper end defined by the vibration plate 70 that is elastically deformable in the thickness direction. The vibration plate 70 may be a sintered upper surface of the flow channel structure 50 made of silicon. Thus, the vibration plate 70 has a higher thermal conductivity than the supply channel structures 60. In the head 13 according to the illustrative embodiment, the vibration plate 70 may be an upper surface of the flow channel structure 50 and overlap the pressure chambers 53*b* in the laminating direction.

The piezoelectric elements 71 are disposed on the vibration plate 70 and overlap the respective corresponding pressure chambers 53*b* in the laminating direction. The head 13 further includes a common electrode, a piezoelectric layer, and individual electrodes in this order from below on an upper surface of the vibration plate 70 to constitute the piezoelectric elements 71. The common electrode and the piezoelectric layer are provided in common for a single nozzle row Q. The individual electrodes are provided in a one-to-one correspondence with the pressure chambers 53*b*. The piezoelectric layer may be made of, for example, piezoelectric material including lead zirconate titanate (PZT). The common electrode is maintained at the ground potential. The individual electrodes are connected to the head driver IC. Each individual electrode is maintained at the ground potential or at a certain drive potential by the head driver IC. Each portion sandwiched between a particular portion of a common electrode and a particular individual electrode may be polarized in the laminating direction when the individual electrode is energized, and each portion may function as an active portion.

In the piezoelectric elements 71, in a state where the head 13 does not allow ejection of liquid droplets from the respective nozzles 18 (e.g., a standby state), all of the individual electrodes are maintained at the ground potential as with the common electrode. For ejecting a liquid droplet from a particular nozzle 18, the controller 40 causes an individual electrode of the piezoelectric element 71 corresponding to a pressure chamber 53*b* that is connected to the particular nozzle 18 to be at a certain drive potential. In response to the potential change of the individual electrode, a piezoelectric element 71 corresponding to the individual electrode is deformed to protrude toward the pressure chamber 53*b*. Thus, the volume of the pressure chamber 53*b* decreases to increase the pressure (e.g., the positive pressure) applied to liquid in the pressure chamber 53*b*, thereby causing liquid droplet ejection from the particular nozzle 18. After the liquid droplet ejection, the potential of the individual electrode is changed back to the ground potential. Thus, the piezoelectric element 71 is returned to the state before deformation.

Both of the sealing substrates 72 may have the same configuration, and therefore, one of the sealing substrates 72 will be described in detail. A sealing substrate 72 seals piezoelectric elements 71 to prevent oxidation of the piezoelectric elements 71 caused by contact with air. The sealing substrate 72 may be made of, for example, silicon. The sealing substrate 72 includes an upper portion 72*a*. The upper portion 72*a* is positioned over the piezoelectric elements 71. A heater 41 is disposed at the upper portion 72*a* of the sealing substrate 72. The sealing substrate 72 further includes side portions 72*b*. The side portions 72*b* are positioned around the piezoelectric elements 71. The side portions 72*b* stand on the flow channel structure 50, more specifically, on the upper surface of the vibration plate 70, and support the upper portion 72*a*. Such a configuration may thus enable transfer of heat generated by the heater 41 to the vibration plate 70 and the flow channel structure 50 through one or more of the side portions 72*b* of the sealing substrate 72.

The sealing substrate 72 and the vibration plate 70 each have a higher thermal conductivity than the supply channel structures 60 made of synthetic resin. Thus, as compared with a case where a heater 41 is disposed at a supply channel structure 60 having a lower thermal conductivity than a sealing substrate 72 like the known configuration, the configuration according to the illustrative embodiment may transfer heat generated by the heater 41 to the flow channel structure 50 effectively.

In particular, in the head 13 according to the illustrative embodiment, one or more of the side portions 72*b* of the sealing substrate 72 includes a heat transfer portion 80 inside thereof. The heat transfer portion 80 is configured to transfer heat generated by the heater 41 to the flow channel structure 50 effectively.

The heater 41 may be a film heater that is configured to be turned on and off by control of the controller 40. The controller 40 is configured to receive detection results from the temperature sensors 42 and turn the heater 41 on or off based on the received results. The temperature sensors 42 are disposed at the flow channel structure 50, more specifically, for example, on the upper surface of the vibration plate 70. Since the heater 41 is a film heater, the heater 41 may be extremely thin and may be fabricated to have a complicated shape, thereby offering a higher degree of flexibility in placement. In addition, the heater 41 may have a surface in contact with the sealing substrate 72 and thus the heater 41 may heat the sealing substrate 72 evenly.

As illustrated in FIG. 3, the flow channel structure 50 has the manifolds 52 at its right and left portions, respectively, in the width direction. Each individual channel 53 extends from a corresponding manifold 52 toward the middle portion of the flow channel structure 50. Thus, the piezoelectric elements 71 and the sealing substrates 72, each of which seals corresponding ones of the piezoelectric elements 71, are positioned on the flow channel structure 50 and between the right and left supply channel structures 60 disposed above the respective manifolds 52. Each sealing substrate 72 may have a rectangular parallelepiped shape. More specifically, for example, each sealing substrate 72 has a hollow structure and extends in the length direction. Such a structure may thus enable each sealing substrate 72 to seal all of corresponding ones of the piezoelectric elements 71 provided for corresponding nozzles 18 in each nozzle row Q. In the illustrative embodiment, for example, two sealing substrates 72 are disposed at the middle portion of the flow channel structure 50 in the width direction and spaced apart from each other at a specified interval.

Figure 4:
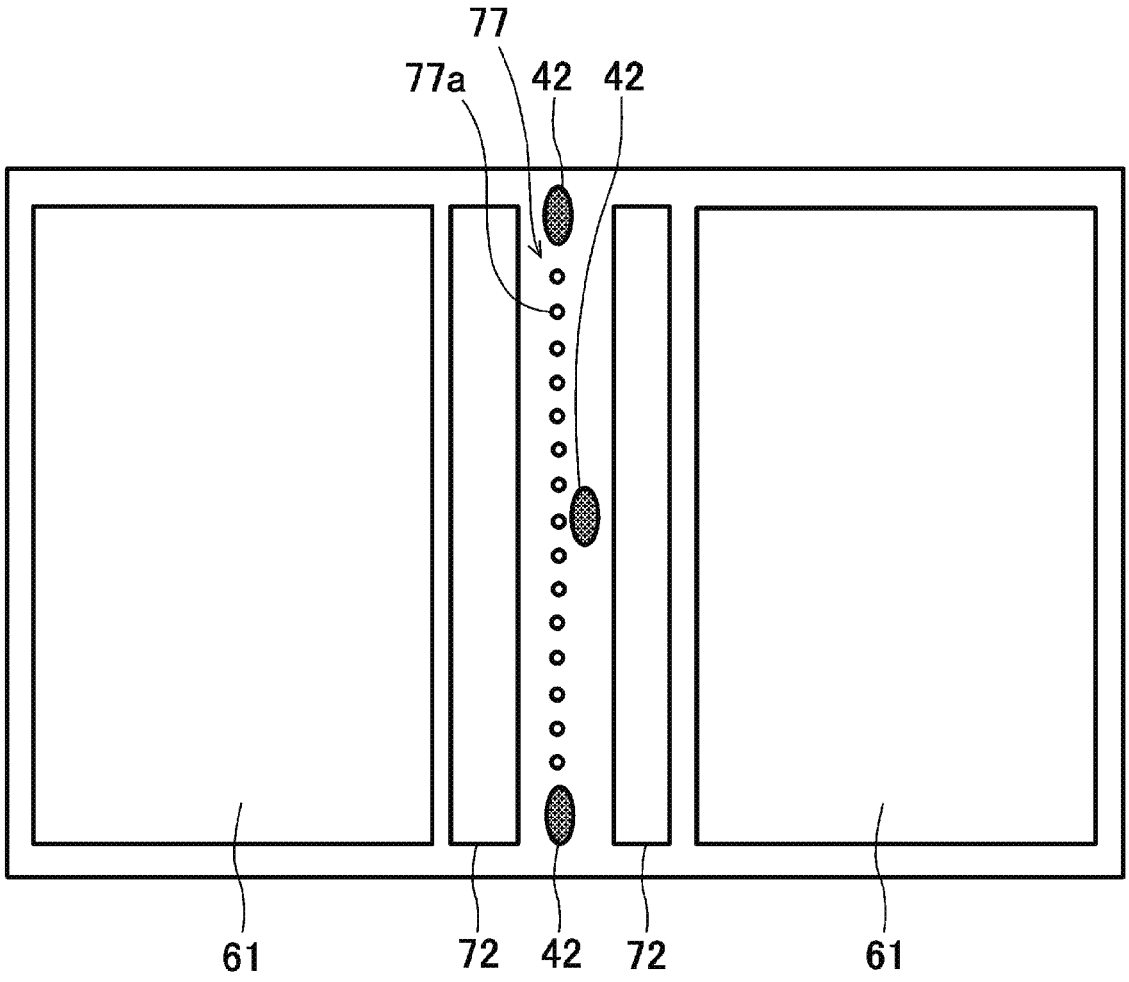
FIG. 4 is a schematic view of the head of FIG. 3 according to the illustrative embodiment of the disclosure, illustrating a planar structure of the head.

A Chip on Film ("COF") 75 (e.g., a wiring board) is disposed between the sealing substrates 72. The COF 75 is connected to the head driver IC for controlling driving of the piezoelectric elements 71. As illustrated in FIG. 4, an electrical connection portion 77 is electrically connected between the COF 75 and a corresponding piezoelectric element 71. The electrical connection portion 77 includes a plurality of contacts 77*a* aligned along the length direction.

The temperature sensors 42 are disposed adjacent to the electrical connection portion 77 provided at the middle portion of the flow channel structure 50 in the width direction. For example, as illustrated in FIG. 4, two of the temperature sensors 42 are disposed at respective ends of the electrical connection portion 77 in the length direction and one of the temperature sensors 42 is disposed adjacent to a middle portion of the electrical connection portion 77. The electrical connection portion 77 is elongated in the length direction. Such an arrangement of the temperature sensors 42 may thus enable the temperature sensors 42 to measure temperature of liquid in all of the individual channel 53.

A space between the sealing substrates 72 is filled with a potting material 76 as illustrated in FIG. 3. The COF 75 is held by the potting material 76 and one of the side portions 72*b* of one of the sealing substrates 72. Such a configuration may thus secure the COF 75 to a certain position and reduce or prevent heat of liquid flowing through the ejection channels 51 from escaping to the outside of the head 13.

The heater 41 is positioned on the sealing substrate 72. That is, the heater 41 is positioned adjacent to the piezoelectric elements 71. The piezoelectric elements 71 are configured to, when being driven, generate heat. In the illustrative embodiment, the heater 41 that generates more amount of heat than the piezoelectric elements 71 is disposed adjacent to the piezoelectric elements 71. Such an arrangement may thus reduce an effect of a temperature distribution caused in the head 13 by heat generated by the piezoelectric elements 71.

Heat Transfer Portion

Figure 5:
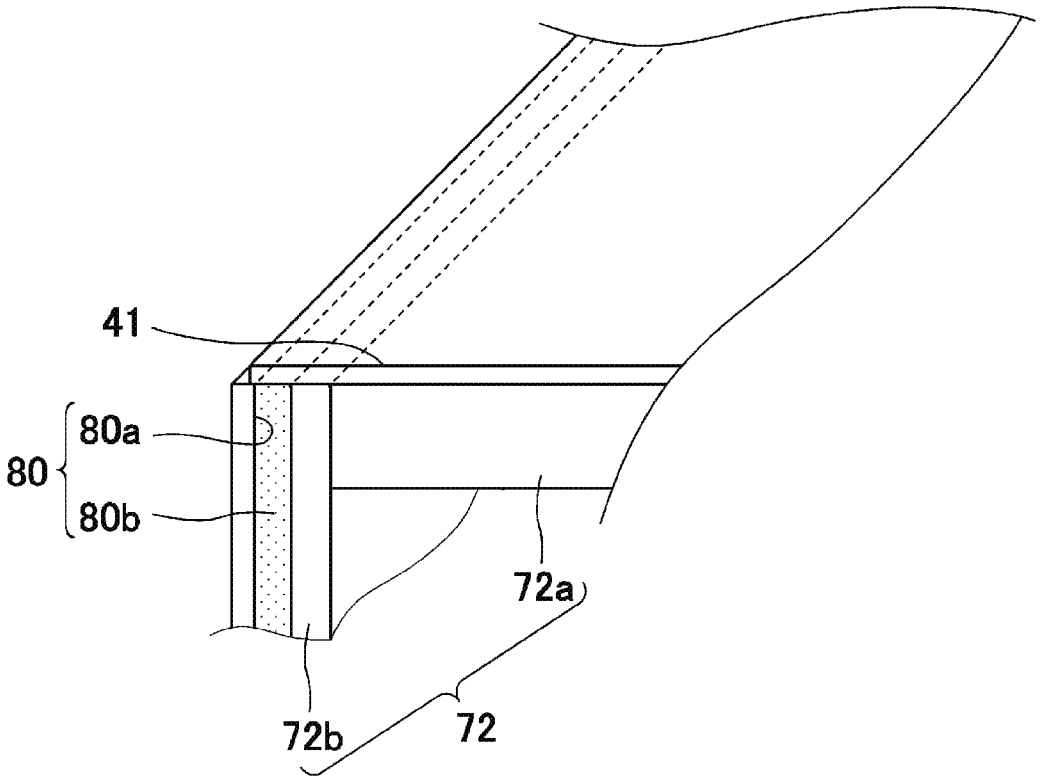
FIG. 5 is a partially enlarged perspective view illustrating one example of a sealing substrate and a heat transfer portion provided in the sealing substrate of FIG. 3 according to the illustrative embodiment of the disclosure.

As illustrated in FIGS. 3 and 5, one or more of the side portions 72*b* of the sealing substrate 72 includes a heat transfer portion 80 therein. The heat transfer portion 80 includes a cavity 80*a* and a heat conductor 80*b*. The cavity 80*a* extends in the laminating direction. The heat conductor 80*b* is disposed in the cavity 80*a*. The heat conductor 80*b* may be made of metal. In the illustrative embodiment, as illustrated in FIGS. 3 and 5, the four side portions 72*b* may each have a flat plate-like shape and surround the sides of the piezoelectric elements 71. The right and left side portions 72*b* extend along the length direction. The front and rear side portions 72*b* extend along the width direction. While each of the right and left side portions 72*b* include the heat transfer portion 80, the front and rear side portions 72*b* might not include the heat transfer portion 80. Nevertheless, in other embodiments, for example, the front and rear side portions 72*b* may also include such a heat transfer portion 80 as well as the right and left side portions 72*b*.

As illustrated in FIG. 5, the cavity 80*a* has a rectangular shape having longer sides extending along the length direction in accordance with the shape of the side portion 72*b*. The metallic heat conductor 80*b* is fitted in the cavity 80*a*.

The side portions 72*b* of the sealing substrate 72 include a first side portion 72*b* and a second side portion 72*b* in the width direction. The first side portion 72*b* is positioned closer to the middle portion of the flow channel structure 50 in the width direction than the second side portion 72*b* is to the middle portion of the flow channel structure 50. The first side portion 72*b* has wiring that is connected between the COF 75 and the piezoelectric elements 71 via the respective corresponding contacts 77*a* of the electrical connection portion 77.

In the first side portion 72*b*, an upper end of the heat transfer portion 80 in the laminating direction is in contact with the heater 41 and a lower end of the heat transfer portion 80 in the laminating direction might not reach the wiring. Thus, in the first side portion 72*b*, heat generated by the heater 41 may be transferred to the heat transfer portion 80 and then further transferred to the vibration plate 70 and the flow channel structure 50 via a lower portion of the side portion 72*b* that is positioned below the heat transfer portion 80.

In the second side portion 72*b*, an upper end of the heat transfer portion 80 in the laminating direction is in contact with the heater 41 and a lower end of the heat transfer portion 80 in the laminating direction is in contact with the vibration plate 70. Thus, in the second side portion 72*b*, heat generated by the heater 41 may be transferred to the vibration plate 70 and the flow channel structure 50 via the heat transfer portion 80.

Figure 6A:
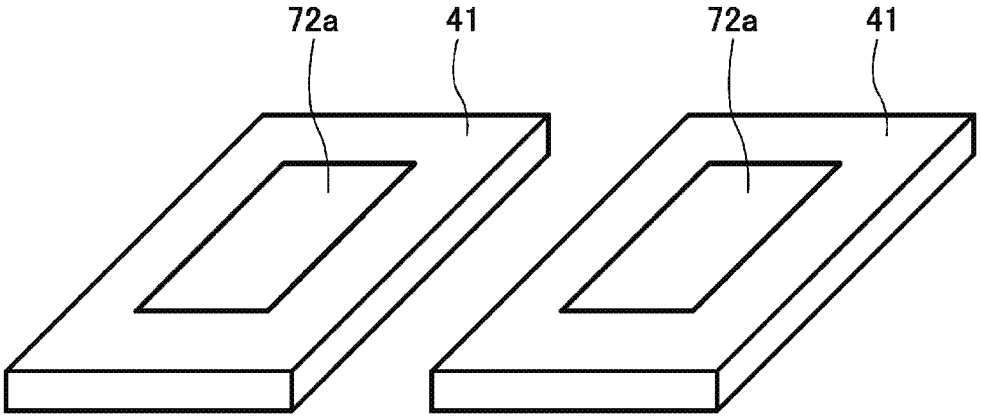
FIG. 6A is a perspective view illustrating an example heater arrangement at upper portions of respective sealing substrates of the head according to the illustrative embodiment of the disclosure, wherein an annular shaped heater is disposed at the upper portion of each of the sealing substrates.
Figure 6B:
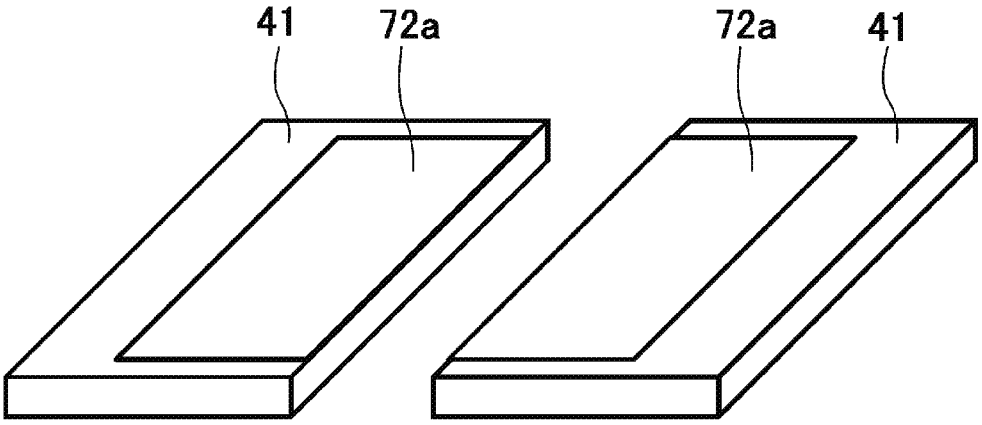
FIG. 6B is a perspective view illustrating another example heater arrangement at upper portions of respective sealing substrates of the head according to the illustrative embodiment of the disclosure, wherein upper surfaces of the upper portions of the sealing substrates are regarded as a single upper surface and an annular shaped heater is disposed at the single upper surface.

In the example illustrated in FIG. 5, the thin-film heater 41 occupies substantially the entire upper surface of the upper portion 72*a* of the sealing substrate 72. Nevertheless, the arrangement manner of the heater 41 at the upper portion 72*a* is not limited to the specific example. In other examples, as illustrated in FIGS. 6A and 6B, a heater 41 may partially occupy the upper surface of the upper portion 72*a* of each of the sealing substrates 72. In one example, as illustrated in FIG. 6A, a heater 41 may have a rectangular annular shape and may be disposed at the upper portion 72*a* of each of the sealing substrates 72. More specifically, for example, the heater 41 may be disposed on the upper surface of each of the sealing substrates 72 such that sides of the heater 41 extend along the respective four sides of the upper surface of the upper portion 72*a*. In another example, a heater 41 may have a circular annular shape and may be disposed on the upper surface of the upper portion 72*a* of each of the sealing substrates 72.

In a case where such an annular shaped heater 41 is disposed on the upper surface of the upper portion 72*a* of each of the sealing substrates 72, the heater 41 may heat the entire upper surface of the upper portion 72*a* evenly. In still another example, as illustrated in FIG. 6B, the upper surfaces of the upper portions 72*a* of the adjacent sealing substrates 72 may be regarded as a single upper surface. A substantially C-shaped heater 41 may be disposed on the upper surface of the upper portion 72*a* of each of the sealing substrates 72 such that the heaters 41 form an annular shape on the single upper surface such that sides of each of the heaters 41 extend along respective four sides of the single upper surface. In such a case, the heaters 41 might not occupy particular areas of the upper surfaces of the upper portions 72*a*. The particular areas may include the sides of the adjacent upper portions 72*a* facing each other and their surroundings. Such an arrangement might not interfere the placement of the COF 75 between the sealing substrates 72.

Figure 7:
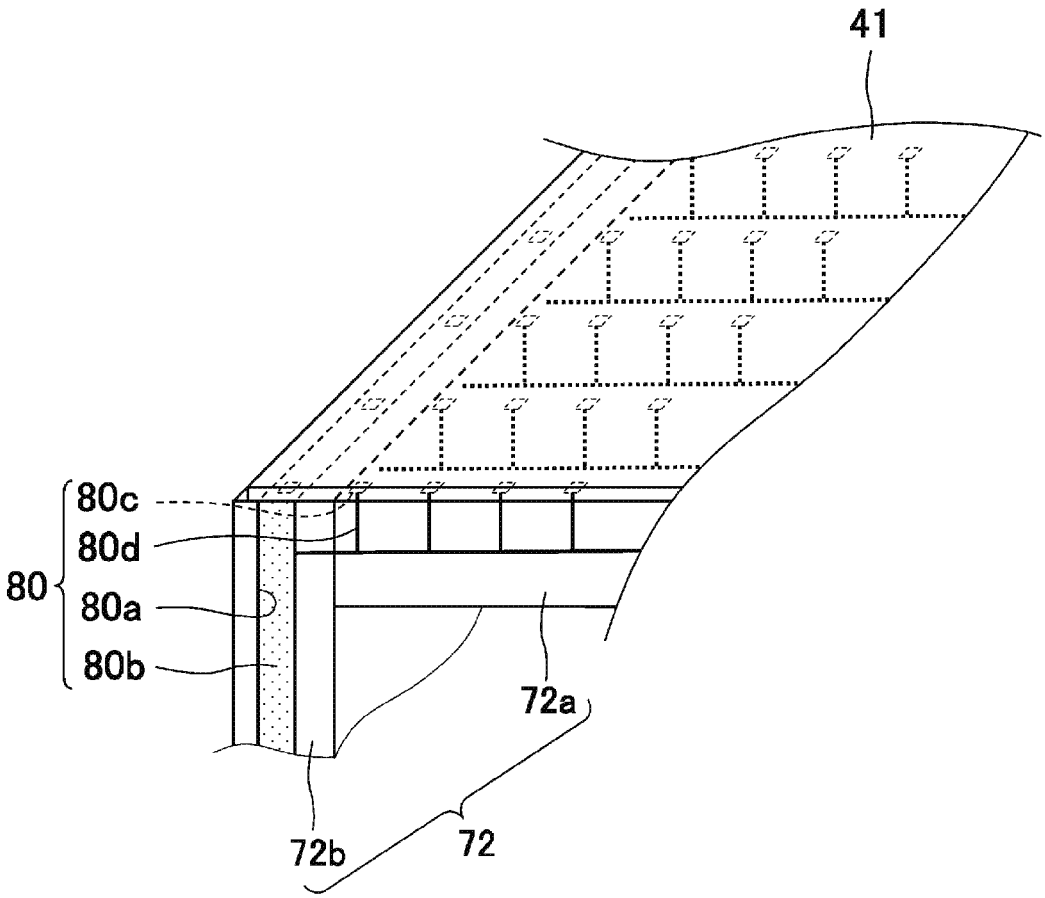
FIG. 7 is a partially enlarged perspective view illustrating another example of a sealing substrate and a heat transfer portion provided in the sealing substrate of FIG. 3 according to the illustrative embodiment of the disclosure.

In the illustrative embodiment, as illustrated in FIGS. 3 and 5, the heat transfer portions 80 are positioned inside the respective first and second side portions 72*b* of each sealing substrate 72. Thus, the heater 41 and the respective heat transfer portions 80 are thermally connected to each other at both ends of the sealing substrate 72 in the width direction where the first and second side portions 72*b* are disposed. Nevertheless, in other embodiments, for example, as illustrated in FIG. 7, a heat transfer portion 80 may further include a plurality of connecting points 80*c* and wires 80*d* at the upper portion 72*a* of the sealing substrate 72. The connecting points 80*c* may be connected to the heater 41 thermally. The wires 80*d* may be routed to be connected between the connecting points 80*c* and a heat conductor 80*b* of the heat transfer portion 80. The wires 80*d* may be made of material having a relatively higher thermal conductivity.

In a case where the heat transfer portion 80 includes the connecting points 80*c* at the upper portion 72*a*, heat generated by the heater 41 may be transferred to liquid flowing through the ejection channel 51 more effectively.

First Modification

Figure 8:
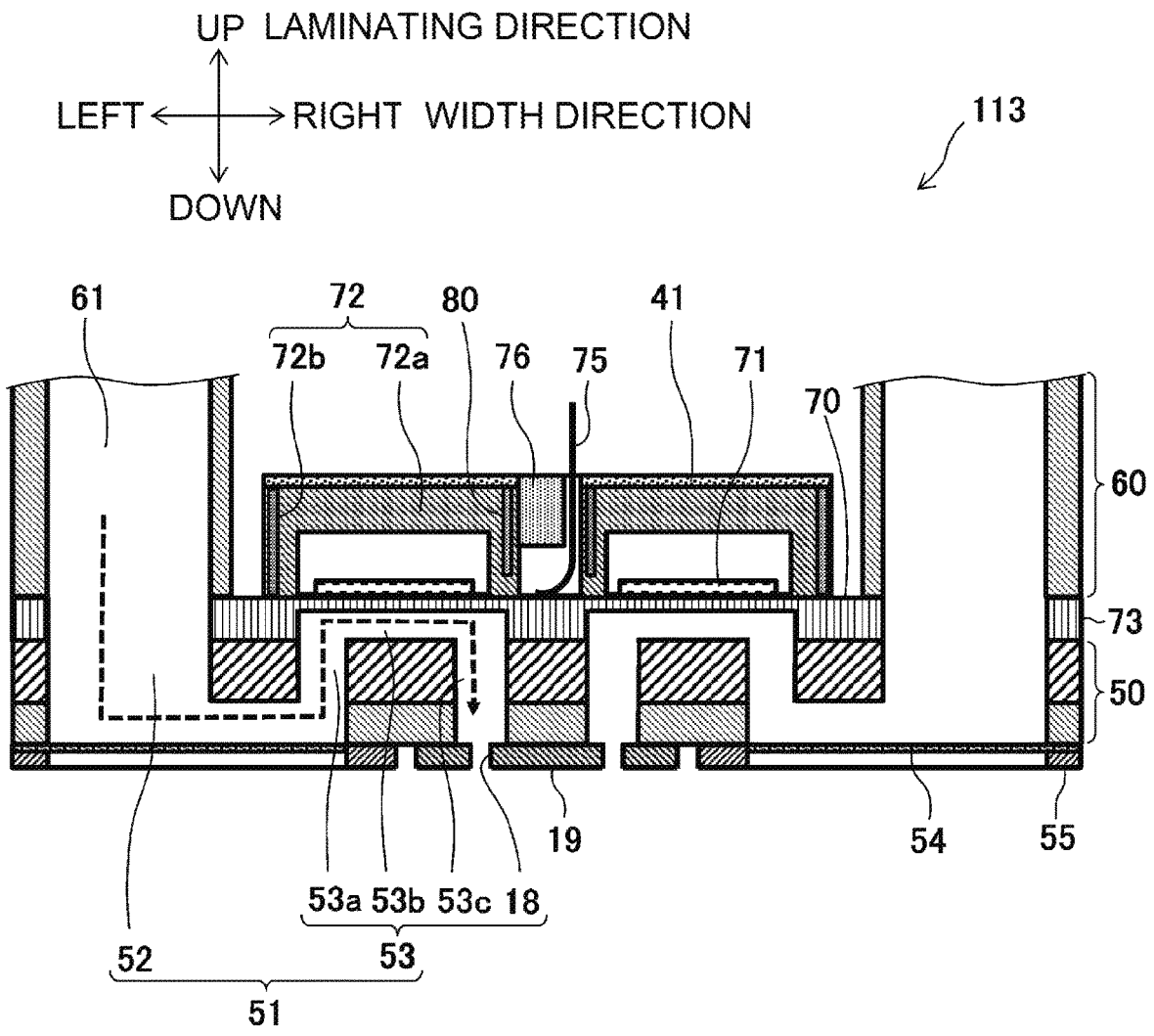
FIG. 8 is a sectional view illustrating a general configuration of a head according to a first modification of the illustrative embodiment of the disclosure.

Referring to FIG. 8, a head 113 according to a first modification will be described. In the head 13 according to the illustrative embodiment, the vibration plate 70 may be the upper surface of the flow channel structure 50 and overlap the pressure chambers 53*b* in the laminating direction. In the first modification, as illustrated in FIG. 8, the head 113 includes an upper flow channel structure 73. A flow channel structure 50 may serve as a lower flow channel structure. The upper flow channel structure 73 includes a vibration plate 70. When viewed from the nozzle surface 19 in the laminating direction, the upper flow channel structure 73 is disposed on the upper surface of the lower flow channel structure 50 and extends over an area including the manifolds 52 as well as the pressure chambers 53*b*. The upper flow channel structure 73 has a higher thermal conductivity than the supply channel structures 60. The head 113 according to the first modification may have the same or a similar configuration to the head 13 according to the illustrative embodiment except that the head 113 includes the upper flow channel structure 73. A description will be therefore omitted for the common components by assigning the same reference numerals thereto.

In the first modification, as illustrated in FIG. 8, the head 113 includes the upper flow channel structure 73 extending over the area including the manifolds 52 as well as the pressure chambers 53*b* of the individual channels 53 when viewed in plan from the nozzle surface 19. Such a configuration may thus enable effective transfer of heat generated by the heater 41 to the manifolds 52 via the upper flow channel structure 73.

Second Modification

Figure 9:
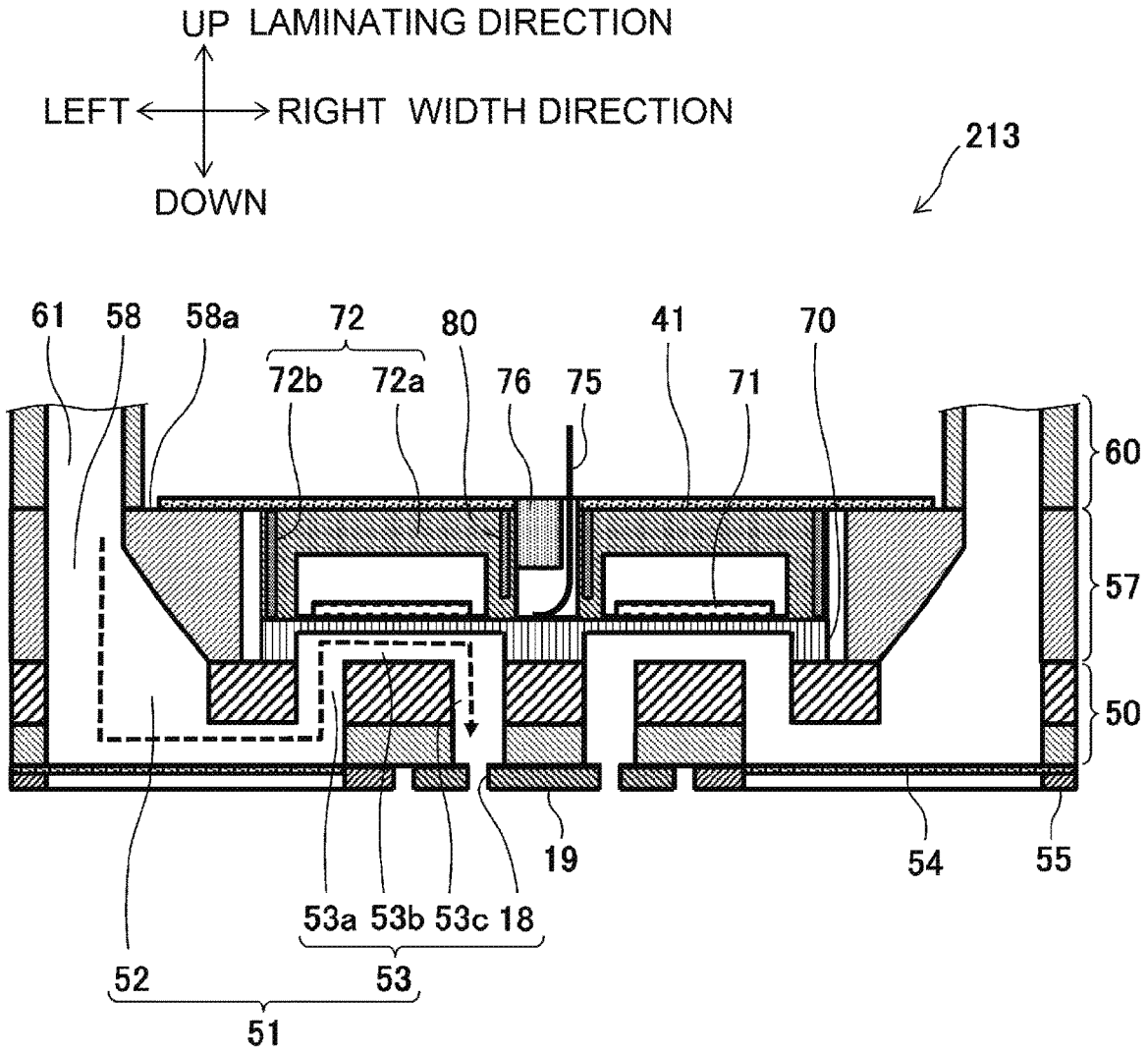
FIG. 9 is a sectional view illustrating a general configuration of a head according to a second modification of the illustrative embodiment of the disclosure.

Referring to FIG. 9, a head 213 according to a second modification will be described. In the head 13 according to the illustrative embodiment, the supply channels 61 of the supply channel structures 60 are positioned above the respective manifolds 52 of the flow channel structure 50. Nevertheless, the head 213 according to the second modification includes an upper manifold member 57 having upper manifolds 58. Manifolds 52 may serve as lower manifolds 52. In the head 213, the upper manifolds 58 are positioned above the respective lower manifolds 52 and the supply channels 61 are positioned above the respective upper manifolds 58. The head 213 according to the second modification may have the same or a similar configuration to the head 13 according to the illustrative embodiment except that the head 213 includes the upper manifold member 57. A description will be therefore omitted for the common components by assigning the same reference numerals thereto.

More specifically, for example, the head 213 includes the lower manifolds 52 of the flow channel structure 50 and the upper manifolds 58 of the upper manifold member 57. The upper manifolds 58 are in communication with the respective lower manifolds 52. That is, as illustrated in FIG. 9, the upper manifolds 58 are positioned directly above the respective lower manifolds 52 in the laminating direction. The supply channels 61 are positioned directly above the respective upper manifolds 58.

The upper manifold member 57 defining the upper manifolds 58 has a higher thermal conductivity than the supply channel structures 60. The upper manifold member 57 may be made of, for example, metal. Examples of metal includes stainless steel. Such a configuration may thus enable easy transfer of heat generated by the heaters 41 to the respective upper manifolds 58 through the upper manifold member 57. In another example, the upper manifold member 57 defining the upper manifolds 58 may be made of, for example, silicon as with the flow channel structure 50 defining the lower manifolds 52.

In the head 213, as illustrated in FIG. 9, the upper surfaces of the upper portions 72*a* of the sealing substrates 72 and an upper surface 58*a* of the upper manifold member 57 are flush with each other. Each heater 41 extends over an area including the upper surface of the upper portion 72*a* of a corresponding sealing substrate 72 and a portion of the upper surface 58*a* of the upper manifold member 57. Such a configuration may thus heat liquid in the upper manifolds 58 effectively.

Both of the upper manifolds 58 may have the same configuration, and therefore, one of the upper manifolds 58 will be described in detail. The upper manifold 58 has a width that gradually increases toward the lower manifold 52 from a connecting portion at which the upper manifold 58 and the supply channel 61 are connected to each other. More specifically, for example, the upper manifold 58 is defined by side surfaces. One of the side surfaces in the width direction is closer to the middle portion of the upper manifold member 57 than the other of the side surfaces in the width direction to the middle portion of the upper manifold member 57. The one side surface is inclined toward the middle portion of the upper manifold member 57 such that the width of the upper manifold 58 gradually increases toward the lower manifold 52.

Such a configuration may thus reduce a channel resistance imparted to the flow of liquid from the supply channel 61 to the lower manifold 52. The one side surface defining the upper manifold 58 is inclined toward the middle portion of the upper manifold member 57. Such a configuration may thus reduce build-up of air in the upper manifold 58 and the lower manifold 52.

Note that plural same components have the same or similar configuration and function in the same or similar manner to each other. Therefore, one of the plural same components will be referred to. According to one or more aspects of the disclosure, a head may include a flow channel structure 50, a supply channel structure 60, a piezoelectric element 71, a sealing substrate 72, and a heater 41. The flow channel structure 50 may define an ejection channel 51 including a particular individual channel 53 and a manifold 52. The particular individual channel 53 may have a particular nozzle 18 and a particular pressure chamber 53*b* in which pressure may be applied to liquid for causing the liquid to be ejected from the particular nozzle 18. The manifold 52 may be configured to allow the liquid to flow therefrom to the particular individual channel 53. The supply channel structure 60 may define a supply channel 61 configured to allow liquid to flow therethrough to the ejection channel 51. The piezoelectric element 71 may be positioned on an upper surface of the flow channel structure 50 and facing the particular pressure chamber via a vibration plate 70. The sealing substrate 72 may be made of material having a higher thermal conductivity than the supply channel structure 60. The sealing substrate 72 may surround the piezoelectric element 71 on the flow channel structure 50 to seal the piezoelectric element 71. The heater 41 may be disposed at the sealing substrate 72.

In the head according to the one or more aspects of the disclosure, heat generated by the heater 41 may thus be transferred to liquid effectively.

According to one or more aspects of the disclosure, in the head having the above configuration, the heater 41 may be a film heater.

Since the heater 41 is a film heater, the heater 41 may be extremely thin and may have be fabricated to have a complicated shape, thereby offering a higher degree of flexibility in placement. In addition, the heater 41 may have a surface in contact with the sealing substrate 72 and thus the heater 41 may heat the sealing substrate 72 evenly.

According to one or more aspects of the disclosure, in the head having the above configuration, the flow channel structure 50, the piezoelectric element 71, and the sealing substrate 72 may be laminated in a laminating direction. The sealing substrate 72 may include an upper portion 72*a* and side portions 72*b*. The upper portion 72*a* may be positioned over the piezoelectric element 71. The heater 41 may be disposed at the upper portion 72*a*. The side portions 72*b* may be positioned around the piezoelectric element 71 and stand on the flow channel structure 50. The side portion 72*b* may support the upper portion 72*a* of the sealing substrate 72. One or more of the side portions 72*b* may include a heat transfer portion 80 having a cavity 80*a* and a heat conductor 80*b*. The cavity 80*a* extends in the laminating direction. The heat conductor 80*b* may be disposed in the cavity 80*a* and may be made of metal.

According to the above configuration of the one or more aspects of the disclosure, the sealing substrate 72 may include the heat transfer portion 80. The heater 41 and the flow channel structure 50 may thus be thermally connected to each other. Consequently, such a configuration may enable effective transfer of heat generated by the heater 41 to the flow channel structure 50.

According to one or more aspects of the disclosure, in the head having the above configuration, the ejection channel 51 may include a further particular individual channel 53 having a further particular nozzle 18 and a further particular pressure chamber 53*b*. It may be assumed that a nozzle row direction, in which the particular nozzle 18 and the further particular nozzle 18 are aligned in a row in a nozzle surface 19 of the head where the particular nozzle 18 and the further particular nozzle 18 are defined, is defined as a length direction of the head. The head 13 may further include a COF 75 (e.g., a wiring board), an electrical connection portion 77, and a plurality of temperature sensors 42. The COF 75 may be connected to a head driver IC (e.g., a driving portion) configured to control driving of the piezoelectric element 71. The electrical connection portion 77 may be elongated in the length direction and electrically connected between the COF 75 and the piezoelectric element 71. The electrical connection portion 77 may include a plurality of contacts 77*a* aligned along the length direction. The plurality of temperature sensors 42 may be disposed at respective ends of the electrical connection portion 77 in the length direction and adjacent to a middle portion of the electrical connection portion 77.

According to the above configuration of the one or more aspects of the disclosure, the head may include the temperature sensors 42. Thus, temperature of liquid flowing in the ejection channel 51 heated by heat generated by the heater 41 may be measured.

In addition, the plurality of temperature sensors 42 may be disposed at the respective ends of the electrical connection portion 77 in the length direction and adjacent to the middle portion of the electrical connection portion 77. Such an arrangement of the temperature sensors 42 may thus enable the temperature sensors 42 to measure temperature of liquid in all of the individual channels 53.

According to one or more aspects of the disclosure, the head having the above configuration may further include an upper flow channel structure 73. The upper flow channel structure 73 may include the vibration plate 70 and have a higher thermal conductivity than the supply channel structure 60. It may be assumed that a direction perpendicular to the length direction with respect to the nozzle surface is defined as a width direction of the head 13. The manifold 52 may be positioned to one side of the particular pressure chamber 53*b* and the further particular pressure chamber 53*b* in the width direction in the flow channel structure 50. When viewed in plan from the nozzle surface, the upper flow channel structure 73 may be positioned on an upper surface of the flow channel structure 50 and extend over an area including the particular pressure chamber 53*b*, the further particular pressure chamber 53*b*, and the manifold 52.

According to the above configuration of the one or more aspects of the disclosure, when viewed in plan from the nozzle surface 19, the head may include the upper flow channel structure 73 extending over the area including the particular pressure chamber 53*b*, the further particular pressure chamber 53*b*, and the manifold 52. Such a configuration may thus enable effective transfer of heat generated by the heater 41 to the manifold 52 via the upper flow channel structure 73.

According to one or more aspects of the disclosure, the head having the above configuration may further include an upper manifold member 57 defining an upper manifold 58. The manifold 52 of the flow channel structure 50 may serve as a lower manifold. The upper manifold 58 may be positioned above the lower manifold 52 and may be in communication with the lower manifold 52. The upper manifold member 57 may have a higher thermal conductivity than the supply channel structure 60.

According to the above configuration of the one or more aspects of the disclosure, the upper manifold member 57 may have a higher thermal conductivity than the supply channel structure 60. Thus, the upper manifold member 57 may further transfer heat generated by the heater 41 and received via the vibration plate 70 to the upper manifold 58 as well as the lower manifold 52 of the flow channel structure 50.

According to one or more aspects of the disclosure, in the head having the above configuration, the upper manifold member 57 may be made of metal.

Such a configuration may thus easily transfer heat generated by the heater 41 to the upper manifold 58.

According to one or more aspects of the disclosure, in the head having the above configuration, an upper surface of the upper portion 72*a* of the sealing substrate 72 may be flush with an upper surface 58*a* of the upper manifold member 57. The heater 41 may extend over an area including the upper portion 72*a* of the sealing substrate 72 and the upper surface 58*a* of the upper manifold member 57.

According to the above configuration of the one or more aspects of the disclosure, the heater 41 may extend over the area including the upper portion 72*a* of the sealing substrate 72 and the upper surface 58*a* of the upper manifold member 57. Such a configuration may thus heat liquid in the upper manifold 58 effectively.

According to one or more aspects of the disclosure, in the head having the above configuration, the heater 41 may have an annular shape and may be disposed at the upper portion 72*a* of the sealing substrate 72.

Such a configuration may thus enable the heater 41 to heat the entire upper surface of the upper portion 72*a* evenly.

The disclosure may be applied to, for example, a liquid ejection head for an inkjet printer that may eject liquid droplets onto a sheet from nozzles.

What is claimed is:

1. A liquid ejection head comprising:

a flow channel structure defining an ejection channel including a particular individual channel and a manifold, the particular individual channel having a particular nozzle and a particular pressure chamber in which pressure is applied to liquid for causing the liquid to be ejected from the particular nozzle, the manifold configured to allow the liquid to flow therefrom to the particular individual channel;

a supply channel structure defining a supply channel configured to allow the liquid to flow therethrough to the ejection channel;

a piezoelectric element positioned above an upper surface of the flow channel structure and facing the particular pressure chamber via a vibration plate;

a wiring board connected to a driving portion configured to control driving of the piezoelectric element;

a sealing substrate made of material having a higher thermal conductivity than the supply channel structure, the sealing substrate surrounding the piezoelectric element on the flow channel structure to seal the piezoelectric element; and a heater disposed at the sealing substrate, wherein the flow channel structure, the piezoelectric element, and the sealing substrate are laminated in a laminating direction, and wherein the heater is disposed at the same position as at least one portion of the wiring board in the laminating direction.

2. The liquid ejection head according to claim 1, wherein the heater is a film heater.

3. The liquid ejection head according to claim 1, wherein the sealing substrate includes:

an upper portion positioned over the piezoelectric element; and side portions positioned around the piezoelectric element and standing above the flow channel structure, the side portions supporting the upper portion of the sealing substrate, wherein the heater is disposed at the upper portion, and wherein one or more of the side portions includes a heat transfer portion including a cavity and a heat conductor, the cavity extending in the laminating direction, and the heat conductor being disposed in the cavity and being made of metal.

4. The liquid ejection head according to claim 3, wherein the ejection channel includes a further particular individual channel having a further particular nozzle and a further particular pressure chamber, wherein a nozzle row direction, in which the particular nozzle and the further particular nozzle are aligned in a row in a nozzle surface of the liquid ejection head where the particular nozzle and the further particular nozzle are defined, is defined as a length direction of the liquid ejection head, the liquid ejection head further comprising:

an electrical connection portion elongated in the length direction and electrically connected between the wiring board and the piezoelectric element; and a plurality of temperature sensors, wherein the electrical connection portion includes a plurality of contacts aligned along the length direction, and wherein the plurality of temperature sensors are disposed at respective ends of the electrical connection portion in the length direction and adjacent to a middle portion of the electrical connection portion.

5. The liquid ejection head according to claim 4, further comprising an upper flow channel structure, wherein the upper flow channel structure includes the vibration plate and has a higher thermal conductivity than the supply channel structure, wherein a direction perpendicular to the length direction with respect to the nozzle surface is defined as a width direction of the liquid ejection head, wherein the manifold is positioned to one side of the particular pressure chamber and the further particular pressure chamber in the width direction in the flow channel structure, and wherein when viewed in plan from the nozzle surface, the upper flow channel structure is positioned on an upper surface of the flow channel structure and extends over an area including the particular pressure chamber, the further particular pressure chamber, and the manifold.

6. The liquid ejection head according to claim 5, further comprising an upper manifold member defining an upper manifold, wherein the manifold of the flow channel structure serves as a lower manifold, wherein the upper manifold is positioned above the lower manifold and is in communication with the lower manifold in the laminating direction, and wherein the upper manifold member has a higher thermal conductivity than the supply channel structure.

7. The liquid ejection head according to claim 6, wherein the upper manifold member is made of metal.

8. The liquid ejection head according to claim 6, wherein an upper surface of the upper portion of the sealing substrate is flush with an upper surface of the upper manifold member, and wherein the heater extends over an area including the upper portion of the sealing substrate and the upper surface of the upper manifold member.

9. The liquid ejection head according to claim 3, wherein the heater has an annular shape and is disposed at the upper portion of the sealing substrate.

* * * * *